US012162066B2

(12) United States Patent
Ruan et al.

(10) Patent No.: US 12,162,066 B2
(45) Date of Patent: Dec. 10, 2024

(54) TRAINING-FREE DATA-DRIVEN METHOD FOR INPUT-OUTPUT MODELING OF COMPLEX PROCESS

(71) Applicant: NUCOR CORPORATION, Charlotte, NC (US)

(72) Inventors: Jianqi Ruan, West Lafayette, IN (US); Robert Gerard Nooning, Jr., Charlotte, NC (US); Ivan David Parkes, Madison, AL (US); Walter Blejde, Brownsburg, IN (US); Neera Jain Sundaram, West Lafayette, IN (US); George T. C. Chiu, West Lafayette, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 18/301,080

(22) Filed: Apr. 14, 2023

(65) Prior Publication Data

US 2023/0330742 A1 Oct. 19, 2023

Related U.S. Application Data

(60) Provisional application No. 63/331,013, filed on Apr. 14, 2022.

(51) Int. Cl.
*B22D 11/16* (2006.01)
*B22D 11/124* (2006.01)

(52) U.S. Cl.
CPC ..... *B22D 11/16* (2013.01); *B22D 11/1245* (2013.01); *B22D 11/1246* (2013.01)

(58) Field of Classification Search
CPC ..... B22D 11/16; B22D 11/06; B22D 11/0622
USPC ..... 164/428, 480, 452, 150.1, 154.1
See application file for complete search history.

(56) References Cited

U.S. PATENT DOCUMENTS 6,129,136 A * 10/2000 Tibbs et al. ..... B22D 11/20 164/154.8
2019/0091761 A1* 3/2019 Browne, III et al. .. B22D 11/16

* cited by examiner

*Primary Examiner* — Kevin P Kerns
(74) *Attorney, Agent, or Firm* — Hahn Loeser & Parks LLP

(57) ABSTRACT

A twin roll casting system includes a pair of counter-rotating casting rolls, a casting roll controller is configured to receive a plant input comprising at least one process control setpoint for the casting rolls. A cast strip sensor measures at least one parameter of the cast strip. A feedback controller receives measurement signals from the cast strip sensor. The feedback controller is a data-driven model including a database of state-input pairs; and executes the following steps at each time step: measure a state-input similarity between a new state observation and samples, assign a weight to each consequent output of samples based on the measured state input similarity, and sum the weighted outputs and predict an output of a new state observation. The feedback controller is configured to provide the control setpoint to the casting roll controller based on the predicted output of the new state observation.

10 Claims, 9 Drawing Sheets

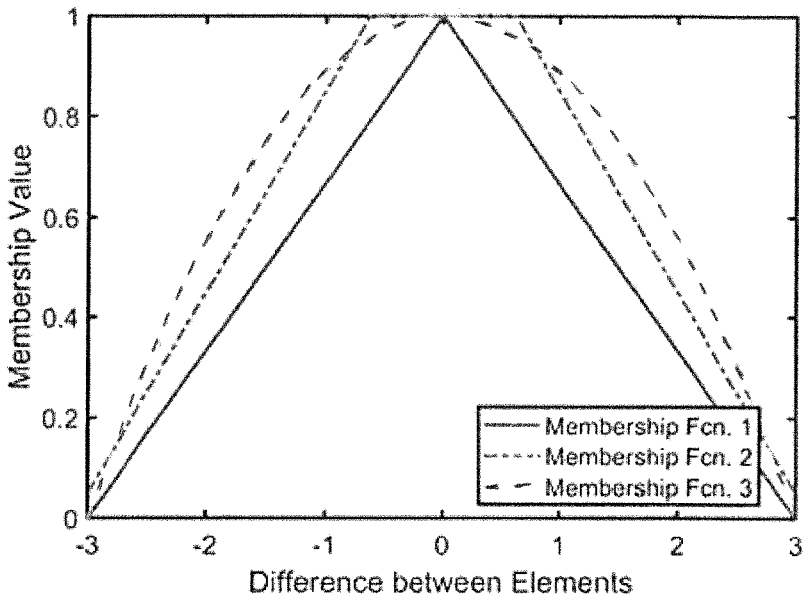

Fig. 1. Different types of membership functions: different shapes of membership curves imply various decay behaviors of the similarity as the difference/distance between two samples increases.

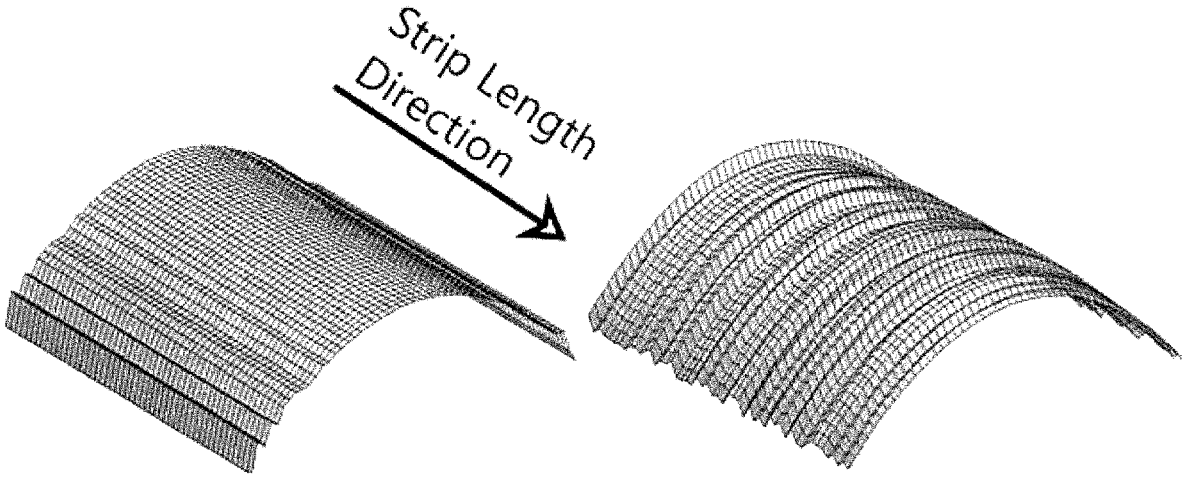

Fig.2a (left) and Fig. 2b(right) Demonstration of different types of profile problems; left figure shows the edge spike problem on each cross section, and right figure shows chatter, the thickness variation along the strip length direction.

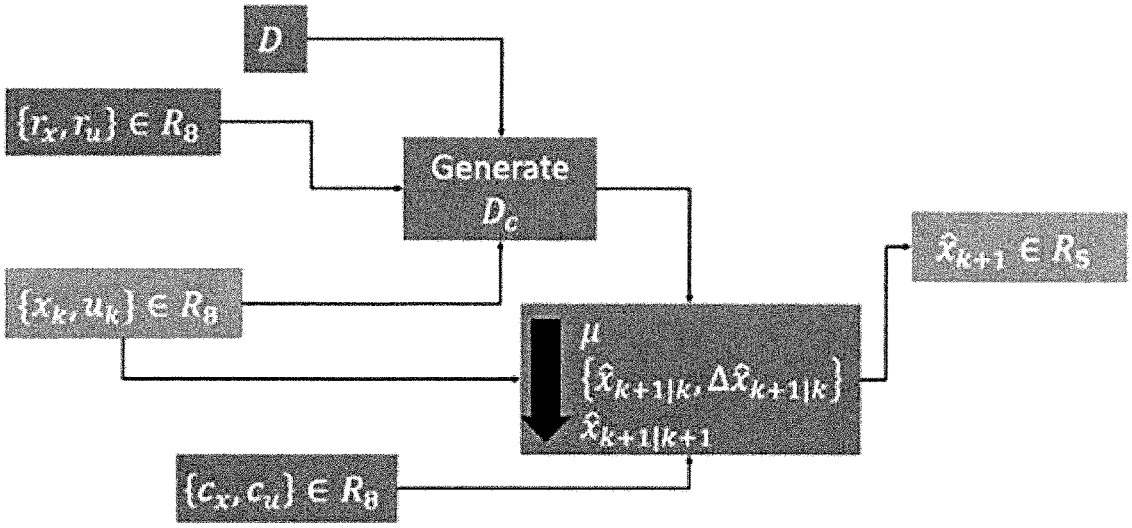

Fig. 7. TFDD model architecture relating roll separation force and time inputs to the strip profile features; at most 16 parameters need to be determined/defined by user.

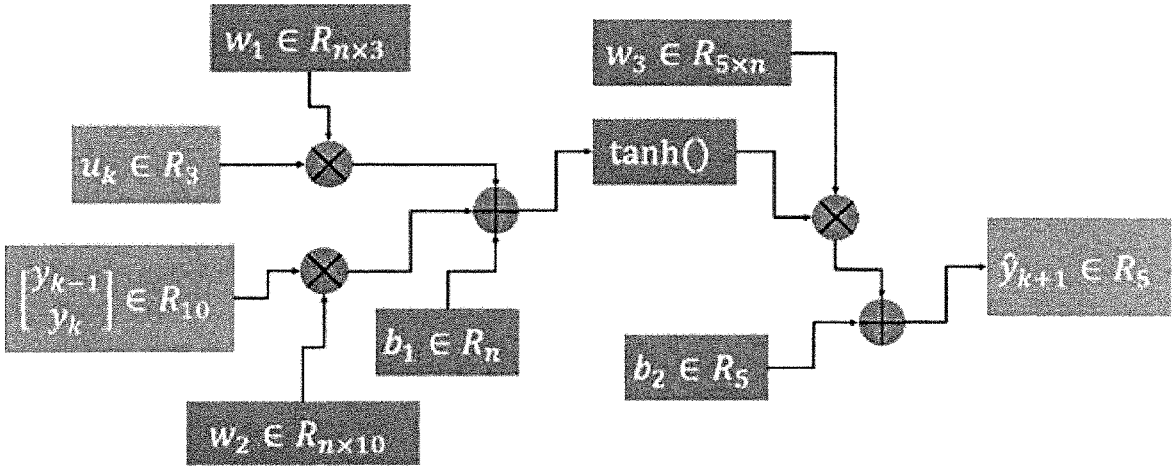

Fig. 8. NARX model architecture relating roll separation force and time inputs to the strip profile features. Since using only uk and yk results in poor prediction performance, yk?1 is applied. Depending on the number of intermediate variables n, the number of parameters to be identified is 19n + 5.

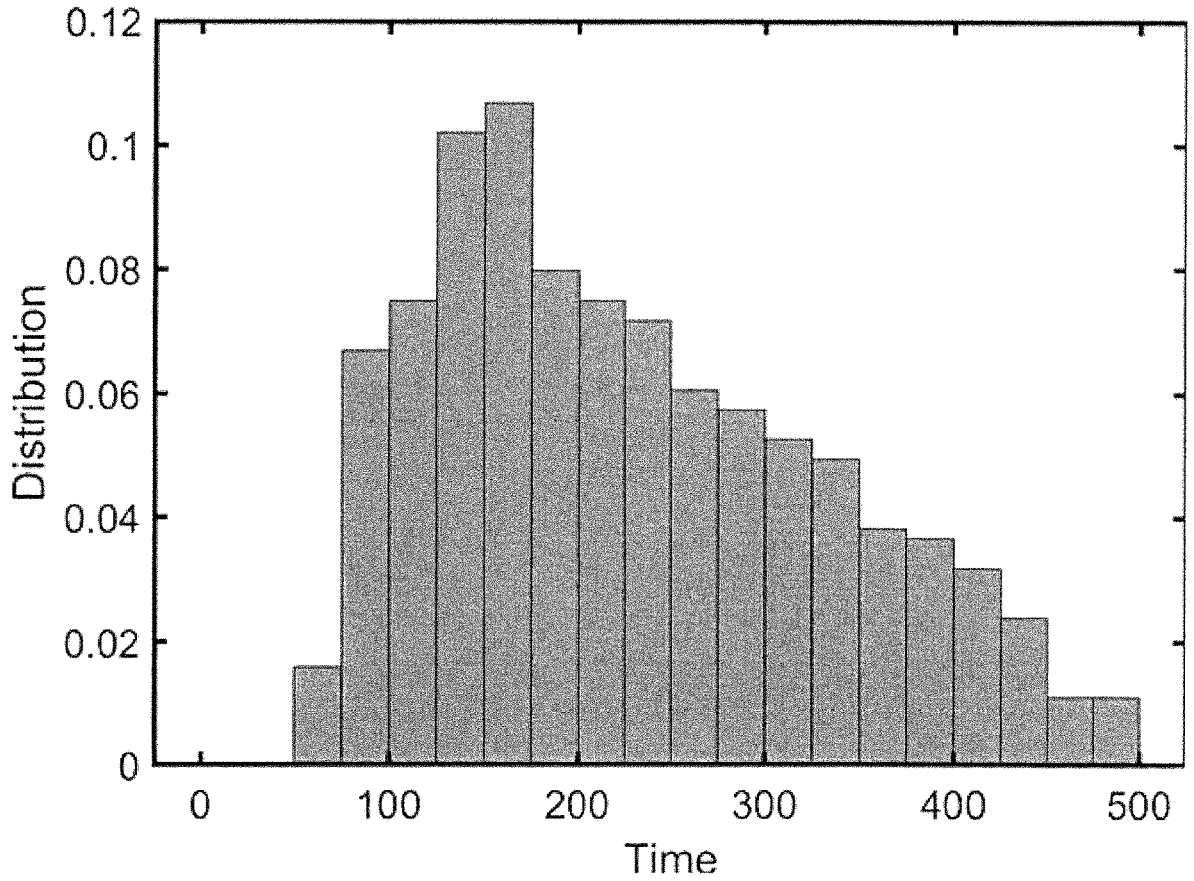
Fig. 9. Histogram of the time range during which human operators made force adjustments. In the training database, there is no force adjustment occurring at $t \in [0, 50]$; 1.5% of force adjustments occur for $t \in [50, 75]$, and 6% occur for $t \in [75, 100]$

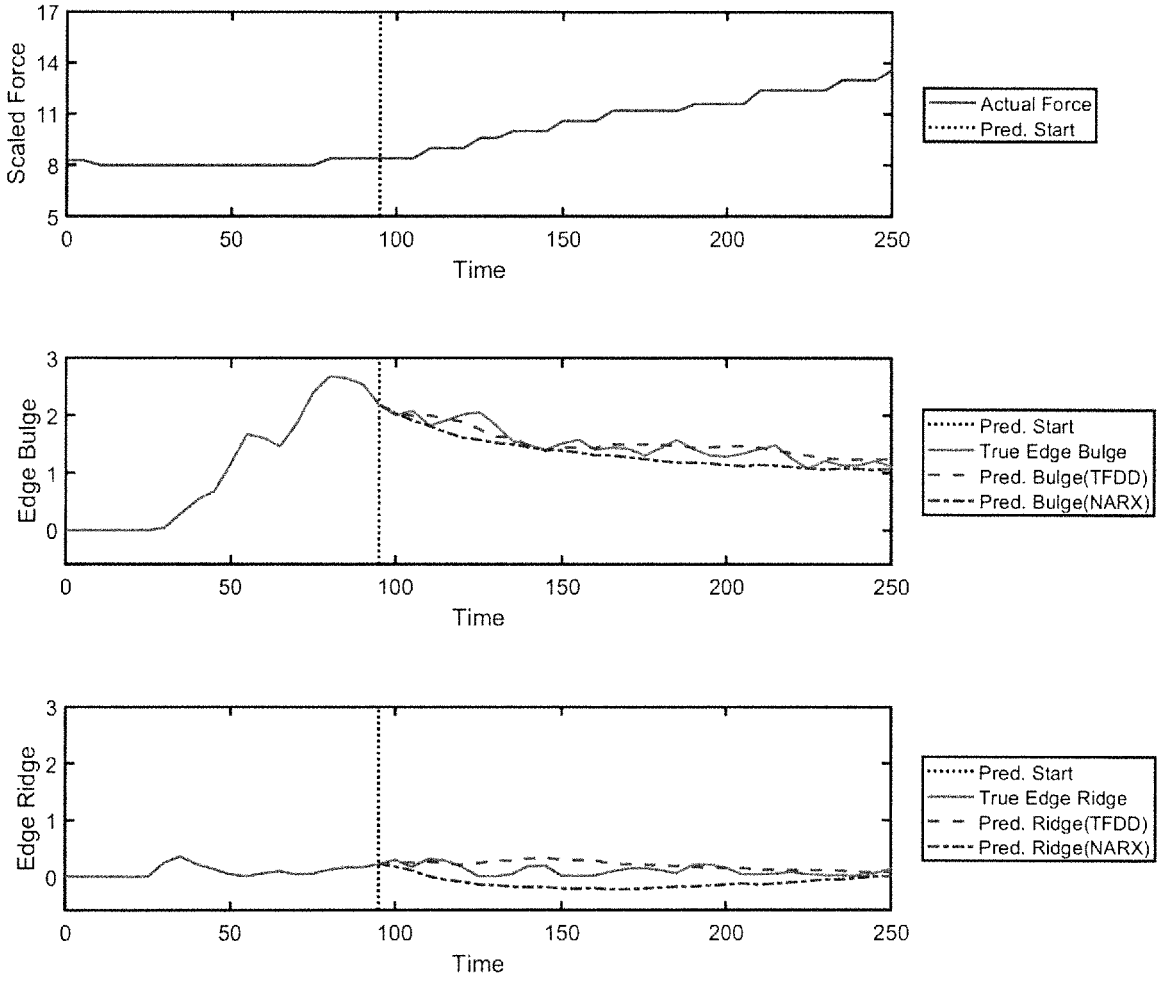
Fig. 10. Performance visualization of both modeling methods: actual force, edge bulge, and edge ridge

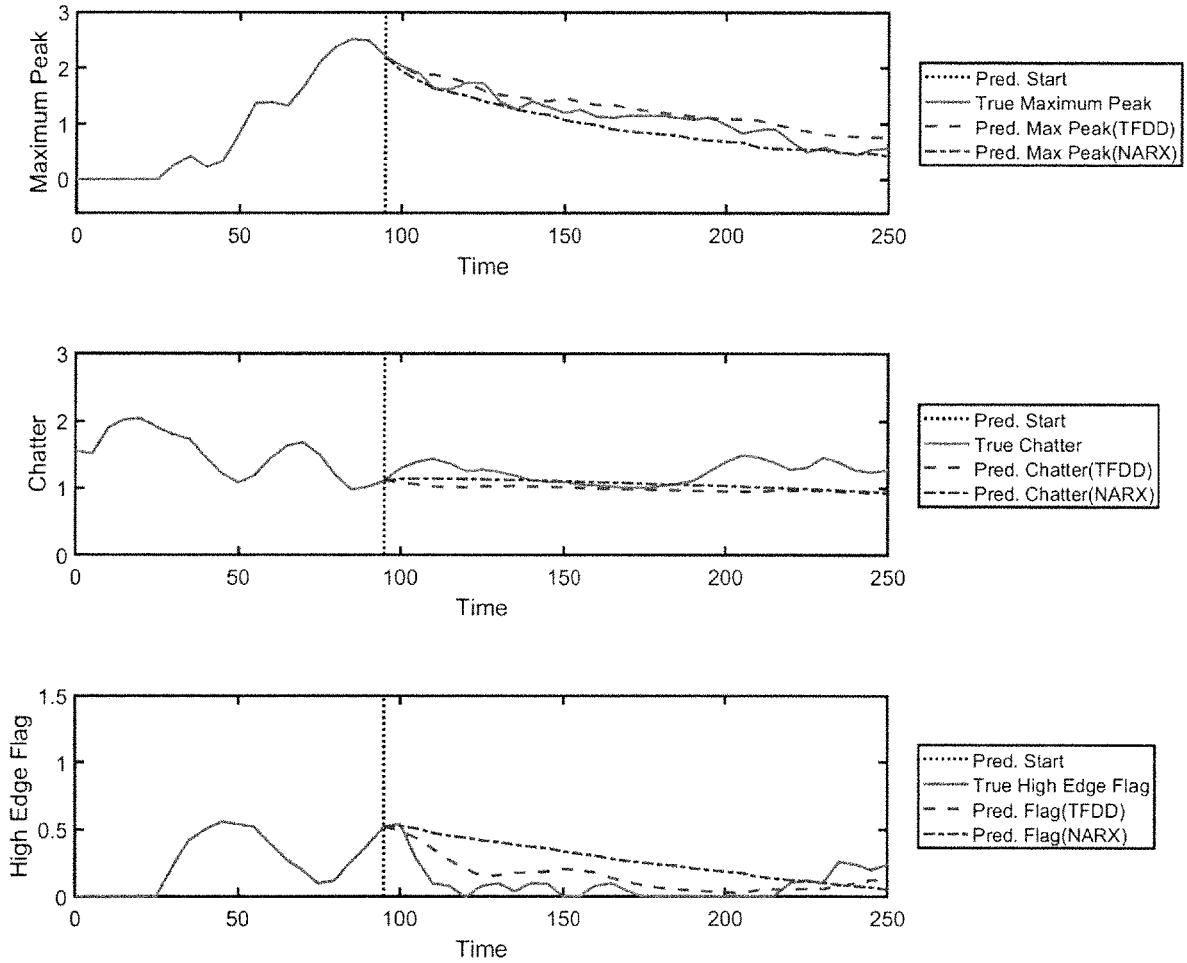
Fig. 11. Performance visualization of both modeling methods: maximum peak, chatter, and high edge flag Method outperforms the NARX with respect to prediction accuracy while requiring no training time.

TRAINING-FREE DATA-DRIVEN METHOD FOR INPUT-OUTPUT MODELING OF COMPLEX PROCESS

INTRODUCTION

In recent years, human-in-the-loop control systems have been widely studied. A subset of human-in-the-loop control systems called supervisory control, in which human operators adjust specific setpoints and supervise a predominantly autonomous process, commonly occurs in industry. However, the diversity of personalities, past experiences, and skill levels among operators causes inconsistency in process operation.

Different approaches have been tried to mitigate this inconsistency and improve the plant performance. One approach is to directly model the system and derive the optimal control strategies based on objectives. A second approach is to build a simulator and let operators practice and explore different control strategies. A third approach is to build a simulator and employ machine learning techniques to discover an optimal control policy. What these three approaches have in common is their reliance on some characterization, or model, of the relationship between human input and performance-related output. However, obtaining such a characterization is not trivial for many complex systems of interest.

Physics-based models of industrial process have been successfully derived and used in many cases. But given the complexity of many such processes, including metal casting, using only first-principles can be very difficult to derive a suitable model of the plant dynamics. At the same time, rapid progress in industrial sensing has spurred the development of data-driven methods for modeling. With respect to data-driven methods, especially those involving an industrial process with molten metal, researchers have developed 1) linear models such as autoregressive with extra input (ARX), 2) nonlinear models involving neural networks, and 3) predictions with fuzzy logic. Linear models have simple structures but are less accurate than nonlinear ones, which are more complex and require more computation to identify parameters. Both linear and nonlinear data-driven models have shown some success. However, their prediction accuracy are marginally better than an autoregression model of the form $\hat{y}(k+1)=ay(k)$. In addition, only some of these models account for human-in-the-loop processes.

SUMMARY

A twin roll casting system according to one aspect of the present invention includes a pair of counter-rotating casting rolls, a casting roll controller, a cast strip sensor, and a controller. The pair of counter-rotating casting rolls have a nip between the casting rolls and are capable of delivering cast strip downwardly from the nip. The casting roll controller is configured to adjust at least one process control setpoint for the casting rolls in response to control signals. The cast strip sensor is capable of measuring at least one parameter of the cast strip. The controller coupled to the cast strip sensor to receive cast strip measurement signals from the cast strip sensor and coupled to the casting roll controller to provide control signals to the casting roll controller, the controller comprising a data-driven model comprising a database of state-input pairs; wherein the controller is configured to execute the following steps at each time step k:

(a) measure a state-input similarity between a new state observation and samples in the database, (b) assign a weight to each consequent output of samples in the database based on the similarity measured, and (c) sum the weighted outputs and predict an output of a new state observation.

The controller is configured to provide the control signals to the casting roll controller based on the predicted output of the new state observation. In some embodiments, the data-driven model is training-free.

In some embodiments, each sample in the sample database comprises a current state, a next state, a state difference between the next state and the current state, and a plant input.

In some embodiments, the controller is further configured to identify a candidate set of samples from the database whose states and inputs are within a predetermined range of a current state and input; and perform steps (a)-(c) of above on the candidate set of samples. In some embodiments, the candidate set of samples is determined with a fuzzy membership function and a defuzzification process.

In some embodiments, the cast strip sensor comprises a thickness gauge that makes state observations by measuring a thickness of the cast strip in intervals across a width of the cast strip.

In some embodiments, the process control setpoint comprises a setpoint for roll separation force of the casting rolls. In some embodiments, at least one state-input pair comprises chatter and a setpoint for the roll separation force of the casting rolls. In some embodiments, at least one state-input pair comprises a state selected from the group consisting of edge bulge, edge ridge, maximum peak, and high edge flag, and the input comprises a setpoint for the roll separation force of the casting rolls. In some embodiments, at least one state-input pair further states of edge bulge, edge ridge, maximum peak, and high edge flag, and the input comprises a setpoint for the roll separation force of the casting rolls.

BRIEF DESCRIPTION OF THE DRAWINGS

FIG. 1 is an illustration of types of membership functions.

FIG. 2*a* is an illustration of edge spike profile defects that occur in thin strip casting.

FIG. 2*b* is an illustration of chatter profile defects that occur in thin strip casting.

FIG. 7 is an illustration of a training-free data driven model architecture according to the present invention.

FIG. 8 is an illustration of a NARX model architecture.

FIG. 9 is a histogram of human operator force adjustments.

FIG. 10 is a performance visualization comparing TDFF model results with NARX model results.

FIG. 11 is a performance visualization of modeling methods.

DETAILED DESCRIPTION

Figure 3:
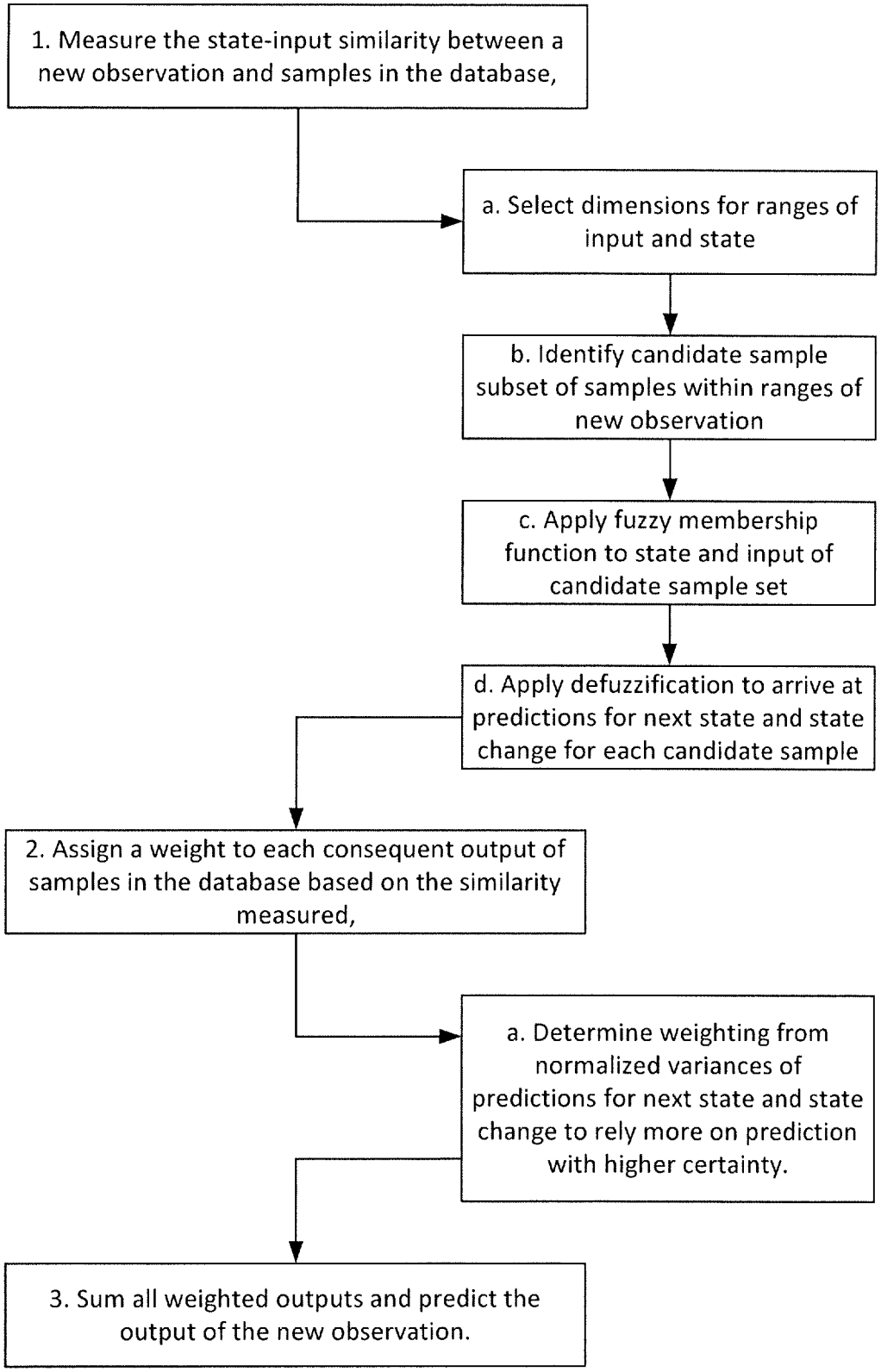
FIG. 3 is a flow diagram illustrating the steps taken by a data driven model according to certain aspects of the present invention.

For the existing data-driven methods, especially for those including neural networks, how similar a model architecture is to that of the real physical process largely affects the model accuracy. Therefore, modeling the effect of the human's input on the process is more challenging. Considering a general nonlinear system with dynamics x(k+1)=f(x(k),u(k)), What is needed is a data-driven method for predicting the state transition from a given state-input pair by using the state transition of some similar state-input pairs in a given database. That is:

$$\hat{x}(k+1) = \sum_{i \in D} w_i x(k_i + 1), \tag{1}$$

where $w_i$ is a similarity weight and D is the set containing all samples similar to the given state-input pair. Since the prediction relies directly on samples in the database, model structure does not need to be specifically designed for a certain system, and the training process is not required.

A training-free data-driven (TFDD) modeling method for simulating the plant dynamics purely from the input-output data is provided. This TFDD method employs the weighted sum of the state transition results of samples in a database to predict the upcoming state of an unseen situation. The ideas of membership function and defuzzification are leveraged to determine the weight of each sample. Due to this property, the disclosed method does not require computational power to determine any model parameter through learning, and its model structure can fit a wide range of complex processes.

In an exemplary embodiment, the TFDD method is applied to a twin-roll steel strip casting process. Verification shows that the TDFF method requires little expertise about the process, and its performance generally exceeds that of a comparable nonlinear autoregressive network with exogenous inputs (NARX) (The MathWorks (2021) model). A principle underlying the proposed TFDD model is to search an existing database of state-input pair samples to identify that which is most similar to a new observed state-input pair. In some embodiments, at each time step k, the following steps are performed:

(1) measure the state-input similarity between a new observation and samples in the database, (2) assign a weight to each consequent output of samples in the database based on the similarity measured, (3) and sum all weighted outputs and predict the output of the new observation.

A full observability of the TFDD system is assumed, and therefore the words state and output may be used interchangeably.

A database is used to construct the TFDD model. The database is composed of samples collected from real physical plant operations. Each sample $S_i$ contains four components: the current state $x_{i,1}$ the next state $x_{i,2}$, the state difference between the next and the current states $\Delta x_{i,2}$, and plant input $u_i$.

$$S_i = \{x_{i,1}, x_{i,2} \Delta x_{i,2}, u_i\} \tag{2}$$

The components $x_{i,1}$, $u_i$ are used to determine the membership of a given state; the components $x_{i,2}$, $\Delta x_{i,2}$ are then used to predict the next state. The database may comprise any set of structured data, such as a relational database, a flat file database, or other suitable structured data format.

Using all samples in the database for prediction can be inefficient. In some embodiments a candidate set is advantageously employed, and only samples in the candidate set are used to predict the next state. The candidate set contains samples whose states and inputs are within a range of the current state and input that is sufficiently close to yield a reliable prediction. Both the state and input ranges of the candidate set can be determined by analyzing samples in the database (discussed more in detail below). In other embodiments, the ranges are determined based on knowledge of the real plant. For a given state-input pair, $(x_k, u_k)$, the candidate set can be expressed as;

$$D_c = \left\{ i \in D_c \text{ if } \begin{pmatrix} |x_{i,2}^1 - x_k^1| \\ \cdots \\ |x_{i,2}^P - x_k^P| \end{pmatrix} < \begin{pmatrix} r_x^P \\ \cdots \\ r_x^P \end{pmatrix}, \begin{pmatrix} |u_i^1 - u_k^1| \\ \cdots \\ |u_i^Q - u_k^Q| \end{pmatrix} < \begin{pmatrix} r_u^1 \\ \cdots \\ r_u^Q \end{pmatrix} \right\}, \tag{3}$$

where P, Q are the dimensions of state and input, respectively.

Referring to FIG. 3, after the database is constructed, and the range of the candidate set is determined, the weight of each candidate sample is determined with fuzzy membership function and a defuzzification process. For a given state $x_k$, both the next state $\hat{x}_{k+1|k}$ and the change between the current and the next state $\Delta\hat{x}_{k+1|k}$ are estimated. While several types of membership functions exist, the prediction calculation with a modified triangular membership function and the center average defuzzifier is demonstrated. As shown in FIG. 1, different membership functions can be used based on how one wants to describe the relationship of similarity and quantity difference. The triangular membership function describes the similarity decaying linearly as the absolute difference increases.

In some embodiments, the triangular membership function is modified with an exponential operation. This modification can mitigate the consequences of having the number of very dissimilar samples outweigh the number of more similar samples. The center average defuzzifier calculates the net similarity by multiplying the similarities of all components and determines the weight by normalizing the net similarity. The step of calculating the net similarity by applying both the modified triangular membership function and the center average defuzzifier can be expressed as $$\mu_i = \prod_{p=1}^{P} \left( e^{1 - \frac{|x_{i,1}^p - x_k^p|}{c_x^p}} \right) \prod_{q=1}^{Q} \left( e^{1 - \frac{|u_{i,1}^q - u_k^q|}{c_u^q}} \right) \tag{4}$$

Where $c_x^p$, $c_u^q$ are scanning factors that are used to normalize the difference between the current and next state, and the current and next input, respectively. A user can set these scaling factors as the maximum state/input difference between two steps among the database or might set these values based on additional understanding of the real system. The predictions of the next state and of the state change are calculated as $$\hat{x}_{k+1|k} = \frac{\sum_{i \in D_c} \mu_i x_{i,2}}{\sum_{i \in D_c} \mu_i} \tag{5}$$

$$\Delta\hat{x}_{k+1|k} = \frac{\sum_{i \in D_c} \mu_i \Delta x_{i,2}}{\sum_{i \in D_c} \mu_i} \tag{6}$$

The final prediction of the next state is a weighted sum of the predictions of the next state $\hat{x}_{k+1|k}$ and of the state change $\Delta\hat{x}_{k+1|k}$.

$$\hat{x}_{k+1|k+1} = \text{diag}(a_i, \ldots, a_P)\hat{x}_{k+1|k} + \text{diag}(b_1, \ldots, b_p)(x_k + \Delta\hat{x}_{k+1|k}), \quad (7)$$

where $$a_p = \frac{\text{Var}(\Delta x_{i,2}^p \mid i \in D_c)}{\text{Var}(\Delta x_{i,2}^p \mid i \in D_c) + \text{Var}(x_{i,2}^p \mid i \in D_c)}, \quad (8)$$

and $$b_p = \frac{\text{Var}(x_{i,2}^p \mid i \in D_c)}{\text{Var}(\Delta x_{i,2}^p \mid u \in D_c) + \text{Var}(x_{i,2}^p \mid i \in D_c)}. \quad (9)$$

The weights $a_p$ and $b_p$ are the normalized sample variances of the state change $\Delta x_{i,2}^p$ and the next state $x_{i,2}^p$ in the candidate sample set $i \in D_c$. They quantify the prediction uncertainty that arises by merely predicting the next state with either $\Delta\hat{x}_{k+1|k}$ or $\hat{x}_{k+1|k}$. A larger uncertainty of the state change among candidate samples results in a larger weight being assigned to the prediction of the next state, and vice versa. Hence, by applying these weights, the final prediction of the next state relies more on the prediction with a lower uncertainty.

Twin-Roll Steel Strip Casting

Twin-roll steel strip casting is a near-net-shape manufacturing process used to improve energy efficiency and reduce operating costs for steel manufacturing. In twin-roll casting, molten steel is poured directly onto the surface of two casting rolls which cool and solidify the steel as two shells, and the two shells formed come together at the nip to form a strip. The process is characterized by rapid thermo-mechanical dynamics which are difficult to control, particularly during the highly transient start-up process. Hence, human operators are tasked with adjusting certain setpoints to achieve desired characteristics of the final product.

A cast sequence start-up process is defined as the period from when the casting process begins to the start of production of the first prime coil. The process is highly non-linear, and factors such as minor differences in the chemical make-up of the steel, even for the same steel grade, can result in a different initial strip profile. The initial strip head end will not be collected for commercial use, and the operators adjust setpoints to drive the process to a steady-state condition that satisfies final prime product requirements including a desired profile in the shortest possible time to minimize the process start up yield loss.

In this process, operators typically adjust the roll separation force setpoint to mitigate a variety of imperfections in the steel strip profile. Along the strip length, surface defects caused by vibration between 35 and 65 Hz of the casting machine, can be effectively reduced by decreasing the roll separation force.

These vibrations are commonly referred to as "chatter". Across the strip length, a slight parabolic shape is desired, but if insufficient roll separation force is applied to the strip, undesirable sharp peaks near the edges of the strip, also called "edge spikes", begin to appear. FIGS. 2*a* and 2*b* show these two major profile problems, chatter and edge spikes. FIG. 2*a* shows the edge spike problem on each cross section, and FIG. 2*b* shows chatter, the thickness variation along the strip length direction.

The relationship between the roll separation force and the strip profile features is extremely difficult to model. Therefore, the proposed TFDD method is applied to develop such a model using experimental input-output data.

To assist operators in quickly comprehending information and making setpoint adjustments, the aforementioned imperfections of the strip profile are quantified, and their time trajectories are plotted and shown to the operators. Moreover, the edge spikes are characterized by four quantities to provide more information.

These quantities are defined as follows:

(1) Chatter (C): strip length direction defection, it is a non-negative value.

(2) Edge bulge (bg): the maximum thickness value among 0 to 25% edge area from the edge side, it is a non-negative value.

(3) Edge ridge (eg): the maximum thickness value among 25% to 50% edge area from the edge side, it is a non-negative value.

(4) Maximum peak (mp): the larger one between edge bulge and ridge with respect to the thickness at the edge area inner end, it is a real value.

(5) High edge flag (fg): a binary value to indicate if either edge is higher than the center strip profile All signals are originally sampled with a 1 Hz sampling rate, and a moving-average filter with window size 10 is applied to smooth each signal. After that, the average of each five consecutive samples is taken without sample overlapping and stored in the training database. Doing so results in a sampling rate that aligns with the minimum time interval between two consecutive human commands.

In one example, the dataset contains 123 cast sequences and is divided into training and testing databases. The training database contains 115 sequences (>5500 samples after processing), and the testing database contains 8 sequences. All data are generated with the same steel grade and width condition using a single casting machine. However, the invention may be applied to various steel grades, widths, and casting machines.

Exemplary Twin-Roll Steel Strip Casting Plant

Figure 4:
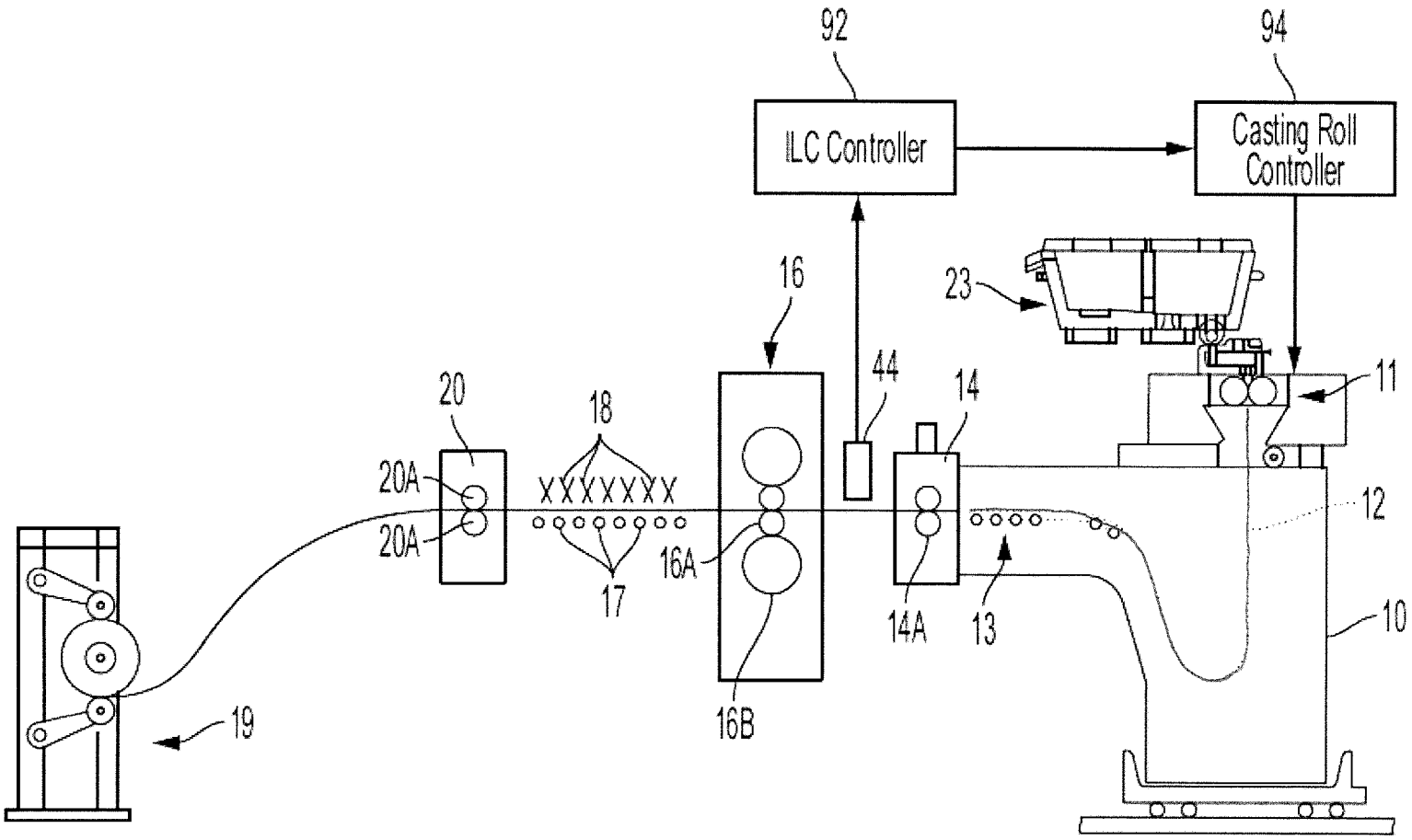
FIG. 4 is an illustration of a twin roll casting plant according to the present invention.
Figure 5:
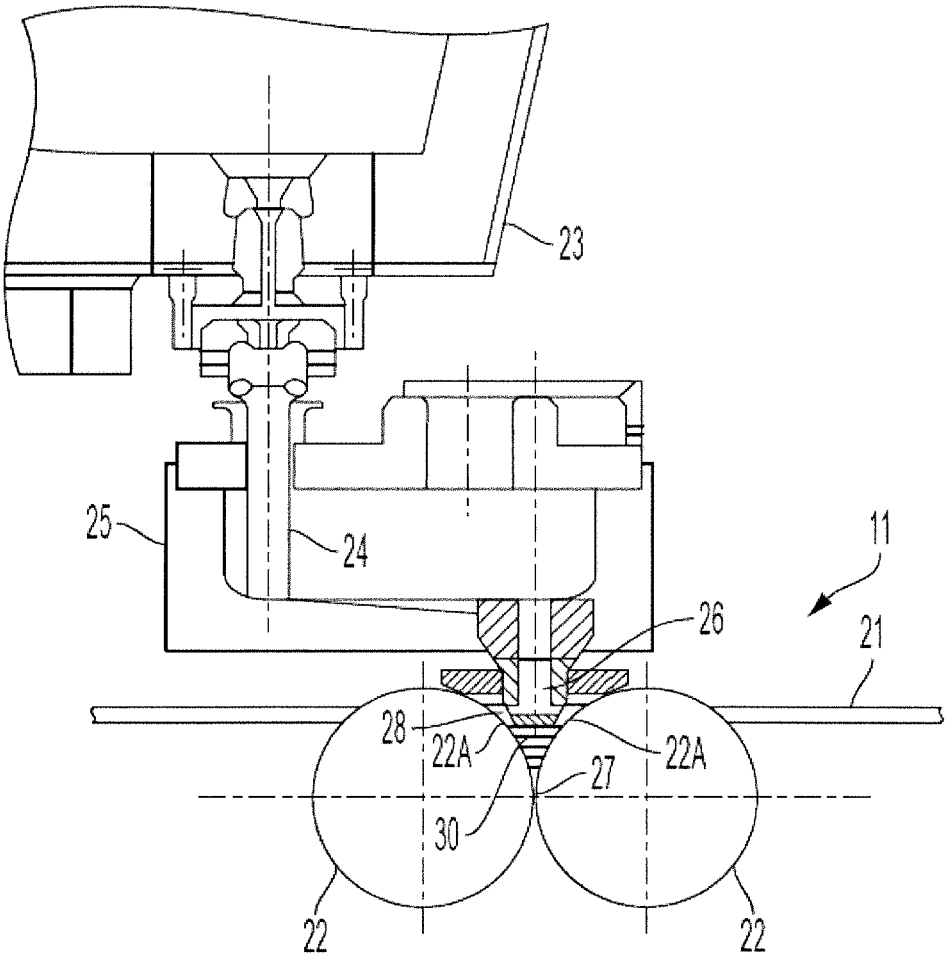
FIG. 5 is an illustration of certain details of the twin roll casting plant.
Figure 6:
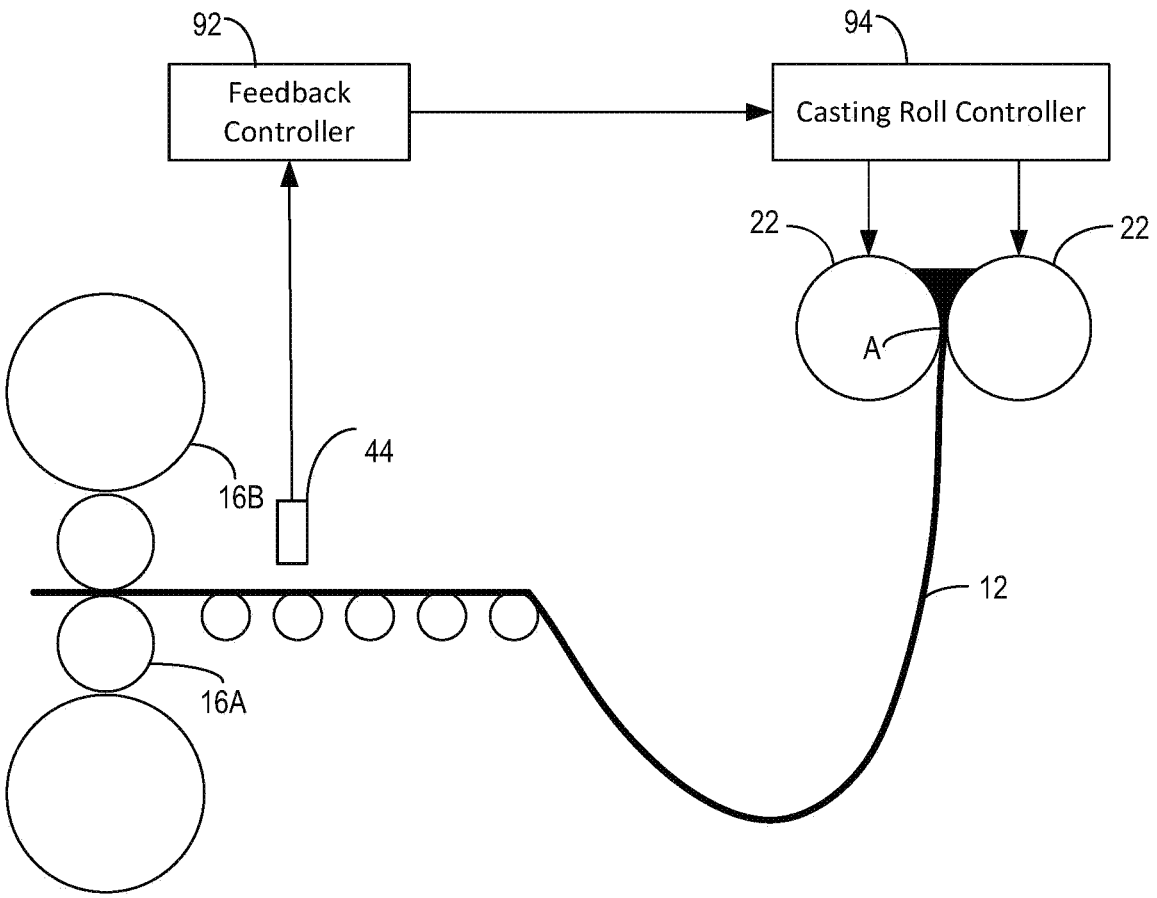
FIG. 6 is a schematic diagram of a control system for a twin roll casting plant according to the present invention.

According to one implementation of the above invention, referring to FIGS. 4, 5, and 6, a twin-roll caster is denoted generally by 11 which produces thin cast steel strip 12 which passes into a transient path across a guide table 13 to a pinch roll stand 14 comprising a pair of pinch rolls 14A. After exiting the pinch roll stand 14, thin cast strip 12 passes into and through hot rolling mill 16 comprised of back up rolls 16B and upper and lower work rolls 16A where the thickness of the strip reduced. The strip 12, upon exiting the rolling mill 16, passes onto a run out table 17 where it may be forced cooled by water jets 18, and then through pinch roll stand 20 comprising a pair of pinch rolls 20A and to a coiler 19.

Twin-roll caster 11 comprises a main machine frame 21 which supports a pair of laterally positioned casting rolls 22 having casting surfaces 22A and forming a nip 27 between them. Molten metal is supplied during a casting campaign from a ladle (not shown) to a tundish 23, through a refractory shroud 24 to a removable tundish 25 (also called distributor vessel or transition piece), and then through a metal delivery nozzle 26 (also called a core nozzle) between the casting rolls 22 above the nip 27. Molten steel is introduced into removable tundish 25 from tundish 23 via an outlet of shroud 24. The tundish 23 is fitted with a slide gate valve (not shown) to selectively open and close the outlet 24 and effectively control the flow of molten metal from the tundish 23 to the caster. The molten metal flows from removable tundish 25 through an outlet and optionally to and through the core nozzle 26.

Molten metal thus delivered to the casting rolls 22 forms a casting pool 30 above nip 27 supported by casting roll surfaces 22A. This casting pool is confined at the ends of the rolls by a pair of side dams or plates 28, which are applied to the ends of the rolls by a pair of thrusters (not shown) comprising hydraulic cylinder units connected to the side dams. The upper surface of the casting pool 30 (generally referred to as the "meniscus" level) may rise above the lower end of the delivery nozzle 26 so that the lower end of the delivery nozzle 26 is immersed within the casting pool.

Casting rolls 22 are internally water cooled by coolant supply (not shown) and driven in counter rotational direction by drives (not shown) so that shells solidify on the moving casting roll surfaces and are brought together at the nip 27 to produce the thin cast strip 12, which is delivered downwardly from the nip between the casting rolls.

Below the twin roll caster 11, the cast steel strip 12 passes within a sealed enclosure 10 to the guide table 13, which guides the strip to a pinch roll, stand 14 through which it exits sealed enclosure 10. The seal of the enclosure 10 may not be complete, but is appropriate to allow control of the atmosphere within the enclosure and access of oxygen to the cast strip within the enclosure. After exiting the sealed enclosure 10, the strip may pass through further sealed enclosures (not shown) after the pinch roll stand 14.

Before the strip enters the hot roll stand, the transverse thickness profile is obtained by thickness gauge 44 and communicated to controller 92. It is in this location that the strip profile is measured. In some embodiments, the controller 92 provides input to the casting roll controller 94 which, for example, may control nip geometry and roll separation force. In some embodiments, controller 92 and controller 94 are combined into a single unit.

Application of TFDD Method to Twin-Roll Casting

To apply the proposed training-free data-driven (TFDD) method, we define the model input as $u_k=\{F_k,a_k, t_k\}$, where $F_k$ is the roll separation force value at the current step, $a_k=F_{k+1}-F_k$ is the force adjustment from the current to the next step, and $t_k$ is the time at the current step with respect to the start of the cast. Note that the action $a_k$ (force adjustment) is not equal to $\Delta F_k$ (change in force). Instead, it represents the force adjustment decision taken by the human operator at step k. Knowledge of absolute force change is not needed because the method does not rely on a physical model of an actual plant. Moreover, the time $t_k$ is included in the input vector because the start-up process is transient; therefore, time similarity in the transient period may imply similarity of the model dynamics. Through analyzing the training database D, upper and lower bounds may be based on the change in force between two steps. In one example, the upper bound $t_{up}$ based on the average time length of the start-up process. With these values, the input range $r_u^a$ may be defined. An example of a TFDD model architecture relating roll separation force and time inputs to the strip profile features is illustrated in FIG. 7. At most 16 parameters need to be determined/defined by user.

In some embodiments, the state vector for the TFDD model contains the five profile features of interest $x_k=\{C, bg, eg, fg, mp\}$. From the training database, the following may be defined:

$$x_k^p-x_{i,2}^p|\leq r_x^p \forall i\in D \text{ and } p\in\{C,bg,eg,fg,mp\};$$

In other words, the change of each state component between two steps is upper bounded by its corresponding r. Based on these values, the criteria of the candidate set may be formed as shown in Eqn. 3. The scaling factors $c_x^p$ or $c_u^q$ are defined as the range of each state or input variable as obtained from the database.

In some embodiments, to reduce the impact of inaccurate prediction caused by a small candidate set, the model outputs the next state as a weighted sum of the current state and the prediction of the next state if the number of samples in the candidate set is less than 10:

$$\hat{x}_{k+1}=\left(1-\frac{n}{10}\right)x_k+\frac{n}{10}\hat{x}_{k+1|k+1}, \tag{10}$$

where n is the number of samples in the candidate set.

Benchmark Model: NARX

To benchmark the performance of the TFDD method, it is compared to a nonlinear autoregressive network with exogenous inputs (NARX) model trained in MATLAB to predict the same process. As shown in FIG. 8, the NARX model characterizes the nonlinear dynamical model as $$y_{k+1}=w_3\left(\tanh\left(w_1u_k+w_2\begin{bmatrix}y_{k-1}\\ y_k\end{bmatrix}+b_1\right)\right)+b_z \tag{11}$$

The input $u_k$ is the same as in the aforementioned TFDD model. To more efficiently train the NARX model, we define a scaled state $y_k$ from the original state $x_k$ as follows:

$$y_k=\frac{x_k-\frac{\left(\max\limits_{i\in D}x_i+\min\limits_{i\in D}x_i\right)}{2}}{\max\limits_{i\in D}x_i-\min\limits_{i\in D}x_i} \tag{12}$$

The performance of the NARX model is evaluated for different numbers of intermediate variables (5 to 10) by calculating the mean square error of between the actual and the predicted scaled states. Table 1 shows that using six intermediate variables results in the best closed-loop performance among all options. FIG. 8. Illustrates a NARX model architecture relating roll separation force and time inputs to the strip profile features. Since using only $u_k$ and $y_k$ results in poor prediction performance, $y_{k-1}$ is applied. Depending on the number of intermediate variables n, the number of parameters to be identified is 19n+5.

TABLE 1

Training/validation mean square errors of different intermediate variables chosen

| Intermediate Variables | Feed Forwarding (Training) | Closed Loop (Validation) |
|---|---|---|
| 5 | 0.0014 | 0.0321 |
| 6 | 0.0014 | 0.0311 |
| 7 | 0.0013 | 0.0366 |
| 8 | 0.0013 | 0.0497 |
| 9 | 0.0013 | 0.0361 |
| 10 | 0.0013 | 0.0344 |

RESULTS

Both TFDD and NARX models are tested using all 8 test sequences. For each sequence, the actual force trajectory and the initial state vector are given. At any step after the initial, each model predicts the upcoming state based on its previous prediction and the actual force value at the current step. FIGS. 10 and 11 show a visualization of both TFDD and NARX predictions for a given testing sequence. Each model begins predicting the process at to =95. Through gradually adjusting the force setpoint, the operator successfully mitigates the profile issues. Both the TFDD and NARX models capture the state trajectories well, and the TFDD model is slightly better as it follows the true trajectory more closely.

FIG. 9 is a histogram of the time range during which human operators made force adjustments. In the training database, there is no force adjustment occurring att∈[0, 50]; 1.5% of force adjustments occur fort∈[50, 75], and 6% occur fort∈[75, 100]. As shown in FIG. 9, the force setpoint is rarely adjusted fort[0, 75]. During the testing process, the TFDD and NARX models are simulated using different initial conditions—$t_0$={45, 70, 95}—to determine how the force adjustment time distribution affects the accuracy of the prediction. Table 2 shows the root mean square error (RMSE) performance (between scaled true and predicted states, scaling as shown in Eqn. 11) for different initial conditions. According to columns 2 and 3, the TFDD model outperforms the NARX model in two of the three cases considered, specifically when $t_0$=70 and $t_0$=95. Both models have better performance as the initial time increases. Columns 4 through 8 also show the RMSE ratio of each state component; in 9 out of 15 cases, the TFDD model outperforms the NARX in predicting the corresponding component for a given initial time, $t_0$.

TABLE 2

Performance comparison between NARX and TFDD models under different initial conditions.

| RMSE Performance | | | RMSE ratio of each variable (TFDD/NARX) | | | | |
|---|---|---|---|---|---|---|---|
| Initial Time | TFDD | NARX | C | bg | rg | fg | mp |
| 45 | 0.2789 | 0.2670 | 1.03 | 1.08 | 0.56 | 1.06 | 1.20 |
| 70 | 0.2012 | 0.2173 | 0.99 | 1.37 | 0.41 | 0.90 | 0.97 |
| 95 | 0.1470 | 0.1578 | 0.95 | 0.79 | 0.81 | 0.87 | 1.02 |

FIG. 10 is a performance visualization of both modeling methods for actual force, edge bulge, and edge ridge. FIG. 11 is a performance visualization of both modeling methods for maximum peak, chatter, and high edge flag. The TFDD method outperforms the NARX with respect to prediction accuracy while requiring no training time.

The TDFF method, as applied to twin roll casting plants, provides several advantages. In one use, the TDFF method may be employed as a simulator to provide feedback and improve human control performance without the expense of operating a casting campaign (and potentially disposing or recycling of extensive scrap materials). In another example, the TDFF method may be employed to generate augmented data for use in training Iterative Learning Controllers, A.I. Controllers, Reinforcement Learning Agent Controllers, etc. In another example, a computer controller may control the casting plant and, based on a current state, generate predicted next states for a plurality of potential inputs, and then select the most optimum input based on the predicted next states.

What is claimed is:

1. A twin roll casting system, comprising:

a pair of counter-rotating casting rolls having a nip between the casting rolls and capable of delivering cast strip downwardly from the nip;

a casting roll controller configured to receive a plant input comprising at least one process control setpoint for the casting rolls;

a cast strip sensor capable of measuring at least one parameter of the cast strip; and a feedback controller coupled to the cast strip sensor to receive cast strip measurement signals from the cast strip sensor and coupled to the casting roll controller, the feedback controller comprising a data-driven model comprising a database of state-input pairs;

wherein the feedback controller is configured to execute the following steps at each time step:

(a) measure a state-input similarity between a new state observation and samples in the database, (b) assign a weight to each consequent output of samples in the database based on the measured state-input similarity, and (c) sum the weighted outputs and predict an output of a new state observation; wherein the feedback controller is configured to provide the at least one process control setpoint to the casting roll controller based on the predicted output of the new state observation.

2. The system of claim 1, wherein the data-driven model is training-free.

3. The system of claim 1, wherein each sample in the sample database comprises:

a current state, a next state, a state difference between the next state and the current state, and plant input.

4. The system of claim 1, wherein the feedback controller is further configured to:

identify a candidate set of samples from the database whose states and inputs are within a predetermined range of a current state and input; and perform steps (a)-(c) of claim 1 on the candidate set of samples.

5. The system of claim 4, wherein the candidate set of samples is determined with a fuzzy membership function and a defuzzification process.

6. The system of claim 1, wherein the cast strip sensor comprises a thickness gauge that makes state observations by measuring a thickness of the cast strip in intervals across a width of the cast strip.

7. The system of claim 1, wherein the at least one process control setpoint comprises a setpoint for roll separation force of the casting rolls; and wherein at least one state-input pair comprises chatter and the setpoint for the roll separation force of the casting rolls.

8. The system of claim 1, wherein the at least one process control setpoint comprises a setpoint for roll separation force of the casting rolls; and wherein at least one state-input pair further comprises a state selected from the group consisting of edge bulge, edge ridge, maximum peak, and high edge flag, and an input comprising the setpoint for the roll separation force of the casting rolls.

9. The system of claim 1, wherein the at least one process control setpoint comprises a setpoint for roll separation force of the casting rolls; and wherein at least one state-input pair further comprises states of edge bulge, edge ridge, maximum peak, and high edge flag, and an input comprising the setpoint for the roll separation force of the casting rolls.

10. A twin roll casting system, comprising:

a pair of counter-rotating casting rolls having a nip between the casting rolls and capable of delivering cast strip downwardly from the nip;

a tundish to deliver molten metal to a casting pool above the nip;

a casting controller configured to receive a plant input comprising at least one process control setpoint;

a sensor capable of measuring at least one parameter of the casting process; and a feedback controller coupled to a cast strip sensor to receive casting process measurement signals from the sensor and coupled to the casting controller, the feedback controller comprising a data-driven model comprising a database of state-input pairs; wherein the feedback controller is configured to execute the following steps at each time step:

(a) measure a state-input similarity between a new state observation and samples in the database, (b) assign a weight to each consequent output of samples in the database based on the measured state-input similarity, and (c) sum the weighted outputs and predict an output of a new state observation;

wherein the feedback controller is configured to provide the at least one process control setpoint to the casting controller based on the predicted output of the new state observation.

* * * * *